US006442770B1

(12) United States Patent
Lin

(10) Patent No.: US 6,442,770 B1
(45) Date of Patent: Sep. 3, 2002

(54) SHUTOFF ASSEMBLY

(76) Inventor: Michael C. H. Lin, 11F, No. 9, Kuang-Fu N. Road, Taipei (TW)

( * ) Notice: Subject to any disclaimer, the term of this patent is extended or adjusted under 35 U.S.C. 154(b) by 0 days.

(21) Appl. No.: 09/953,489

(22) Filed: Sep. 14, 2001

Related U.S. Application Data

(63) Continuation-in-part of application No. 09/611,675, filed on Jul. 7, 2000, now abandoned.

(51) Int. Cl.[7] ..... A47K 1/14
(52) U.S. Cl. ..... 4/295; 4/286
(58) Field of Search ..... 4/286, 293, 295

(56) References Cited

U.S. PATENT DOCUMENTS 4,339,832 A * 7/1982 Cuschera ..... 4/286 X
5,832,545 A * 11/1998 Pan ..... 4/293
6,219,861 B1 * 4/2001 Chen ..... 4/295 X

* cited by examiner

*Primary Examiner*—Robert M. Fetsuga

(57) ABSTRACT

A shutoff assembly includes a main body, a drain cover, a plugging device, and a shutoff cap. The plugging device is disposed in a through hole of the main body and connected to a drain opening coupler. A sliding path is formed in a side recessed slot on the plugging device for a hook lever to slide through. A spring is disposed between the shutoff cap and the plugging device. The drain cover is placed below the top portion of the main body. When the shutoff assembly is pressed, the bottom end of the hook lever is trapped in a bottom recess and the drain cover blocks the drain hole of the drain opening coupler. When the shutoff assembly is pressed again, the hook lever is released and the drain cover is moved up to open the drain hole.

6 Claims, 5 Drawing Sheets

SHUTOFF ASSEMBLY

CROSS-REFERENCES TO RELATED APPLICATIONS

This is a continuation-in-part of U.S. application Ser. No. 09/611,675, filed Jul. 7, 2000.

FIELD OF THE INVENTION

The present invention generally relates to a shutoff assembly of a sink or bathtub, and more specifically to a shutoff assembly that is effective in stopping water flow and can be easily operated.

BACKGROUND OF THE INVENTION

In general, a sink or bathtub has an outlet for draining water. When it is desirable to store water in the sink or bathtub, the most common method for preventing the water from being drained out is blocking the outlet. A plugging device or blocking assembly is often provided to block the outlet. The plugging device may be made of a generic rubber material and plugged into the outlet directly to stop water from flowing into the outlet. The blocking assembly may comprise a stopper controlled by a linking rod which can be moved up or down so that the outlet can be opened or blocked.

The plugging device, which is a device external to the sink, has a drawback in that it is easily lost. The blocking assembly also has a drawback because the outlet may not be completely blocked if the external force exerted to the linking rod is not sufficient. If the linking rod does not cause the stopper to block the outlet tightly, water may leak through the outlet.

SUMMARY OF THE INVENTION

This invention has been made to overcome the above mentioned drawbacks of a conventional plugging device or blocking assembly. The primary object of this invention is to provide a new structure for a shutoff assembly that can be easily operated to open or close an outlet of a sink or bathtub. Another object is to provide a shutoff assembly which can not be lost easily.

According to the invention, the shutoff assembly comprises a drain opening coupler, a drain cover, a main body, a plugging device, and a shutoff cap. The main body has a through hole in which the plugging device is disposed. The plugging device has a bottom bolt stud screwed to a screw hole formed on a coupler seat of the drain opening coupler. A side recessed slot is formed on the plugging device. Within the side recessed slot, a protruded center piece, two side pieces and a bottom triangular piece form a sliding path. A hook lever is disposed in the side recessed slot. The bottom of the hook lever is bent to form a bottom hook which may be trapped into a reversed V-shape recess formed at the bottom of the protruded center piece.

The plugging device has a top hole in which a spring is disposed. The top of the hook lever is attached to a plugging cover which covers the plugging device and the spring. A shutoff cap further covers the plugging cover and the main body. A drain cover is placed below the top portion of the main body to cover the drain hole of the drain opening coupler. When the shutoff assembly is pressed, the bottom hook slides through the sliding path and is trapped into the reversed V-shape recess. The drain cover completely blocks the drain hole to prevent water from being drained out. When the shutoff assembly is pressed again, the bottom hook shifts out of the reversed V-shape recess and moves up through the sliding path. The drain cover also moves up to allow water to be drained out.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
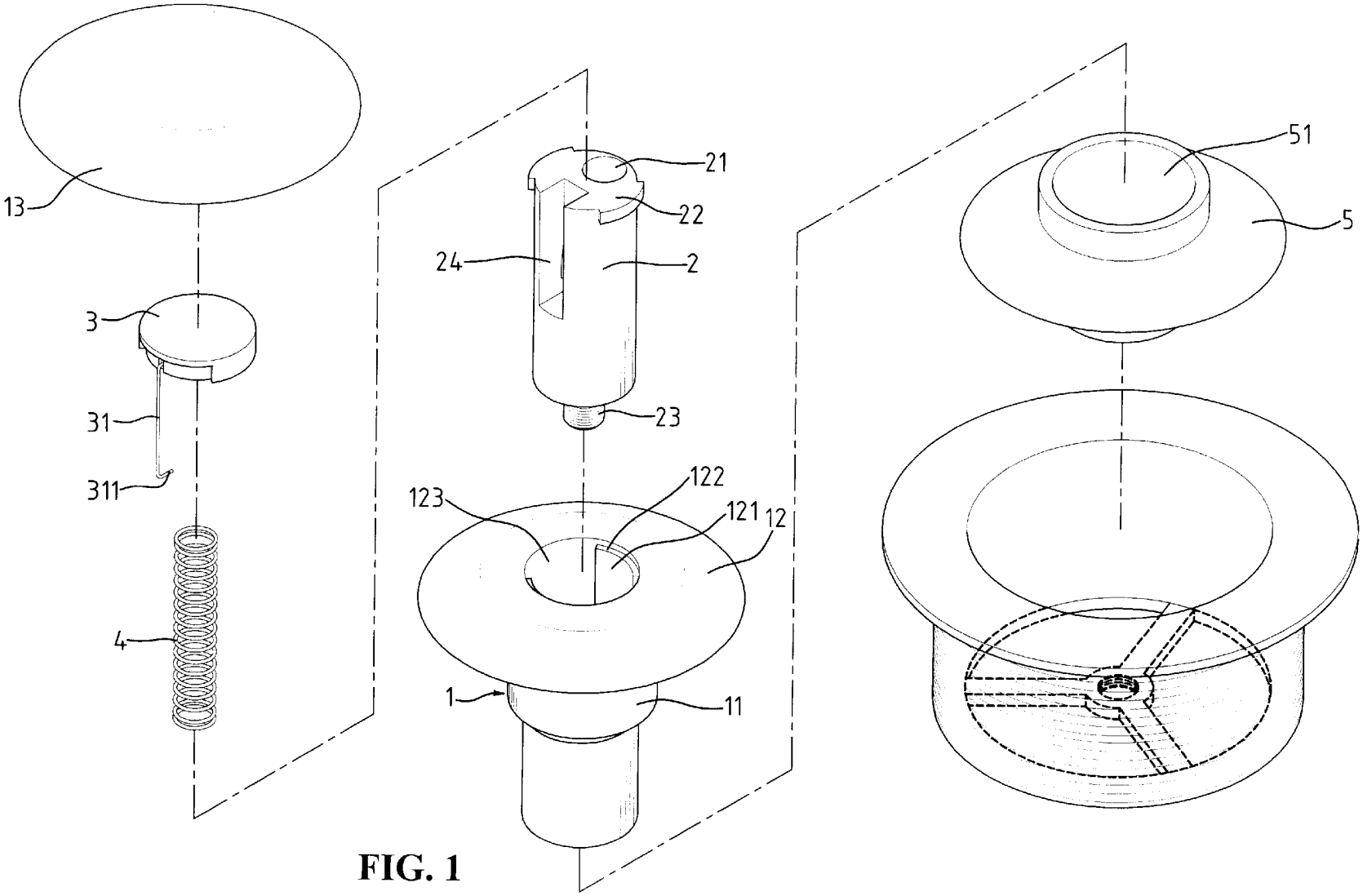
FIG. 1 shows the components of the decomposed shutoff assembly according to this invention.

With reference to FIG. 1, the shutoff assembly of this invention comprises a main body 1, a plugging device 2, a shutoff cap 13 and a drain cover 5. The main body 1 includes a hollow cylindrical body 11 and a shutoff member 12 formed integrally together. Inside the hollow cylindrical body 11 is a through hole 121 for accommodating the plugging device 2. Two protruded portions 122 are formed on the inner sidewall of the through hole 121 near the top of the inner sidewall. The two protruded portions 122 result in two recessed areas 123 on the inner sidewall. As can be seen from FIG. 1, the upper portion of the hollow cylindrical body 11 has a diameter slightly larger than the lower portion.

Figure 2:
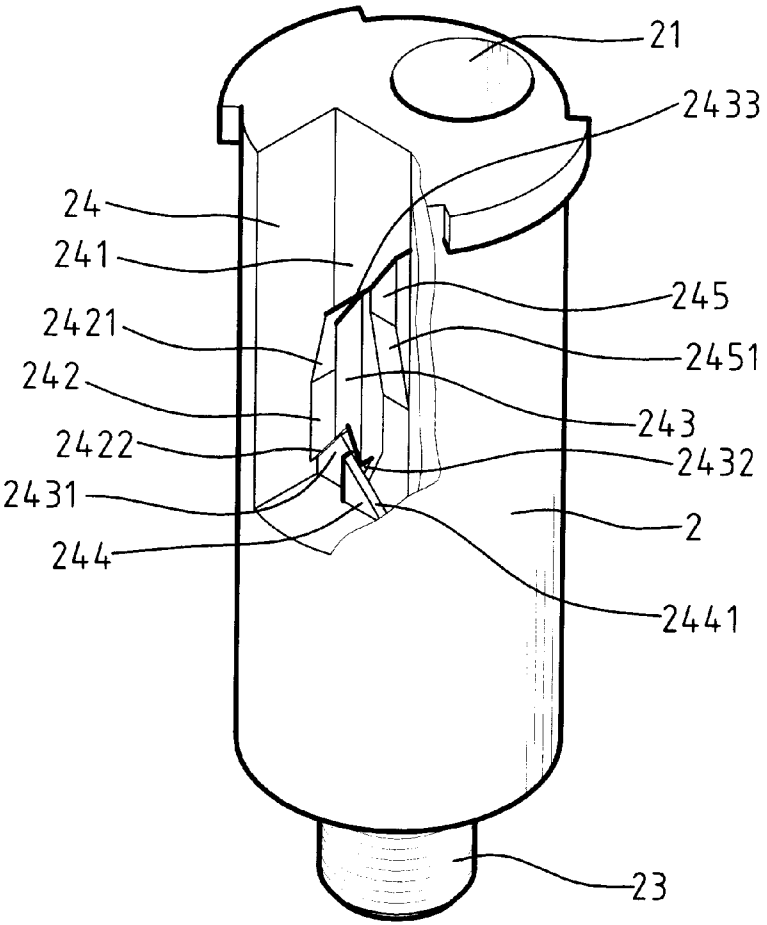
FIG. 2 is a cut-off view of the plugging device of this invention in which a side recessed slot is formed with a protruded center piece, two side pieces and a bottom triangular piece.

The plugging device 2 comprises a side recessed slot 24. A protruded center piece 243 is formed near the bottom of the side recessed slot 24 as shown in FIG. 2. A first side piece 242 and a second side piece 245 are formed on the two opposite sides of the protruded center piece 243 within the side recessed slot 24. The top of the protruded center piece 243 is formed with a slanted side 2433. Because the thickness of the protruded center piece 243 is larger the two side pieces, two sliding channels are formed between the protruded center piece 243 and the sidewall of the side recessed slot 24.

A bottom triangular piece 244 is formed below the protruded center piece 243 at the bottom of the side recessed slot 24. The bottom of the protruded center piece 243 is formed with a reversed V-shape recess 2431. A reversed V-shape channel is thus formed between the bottom triangular piece 244 and the protruded center piece 243. The reversed V-shape channel in connection with the two sliding channels described above forms a sliding path.

The upper portion of the first side piece 242 has a slanted surface 2421 and the lower portion of the first side piece 242 forms a anti-reverse step 2422 which creates a surface drop from the first piece 242 to the reversed V-shape recess 2431. The lower portion of the second side piece 245 has a slanted surface 2451. A slanted side 2441 is formed on one side of the bottom triangular piece 244 near the second side piece 245. An anti-reverse step 2432 is formed near the bottom edge of the reversed V-shape recess 2431. The anti-reverse step 2432 creates a surface drop from the reversed V-shape recess 2431 to the lower portion of the second side piece 245.

A hole 21 is formed on the top potion of the plugging device 2. Two side protruded portions 22 as shown in FIG. 1 are formed on the top surface of the plugging device 2. An elastic member such as a spring 4 is disposed within the hole 21. The bottom of the plugging device 2 is formed with a bolt stud 23. A plugging cover 3 is used to cover the plugging device 2. On one side of the plugging cover 3 is attached with a hook lever 31 whose bottom is bent to form a bottom hook 311. The diameter of the plugging cover 3 is approximately the size of the inner diameter at the top of the through hole 121 of the hollow cylindrical body 11.

Figure 3:
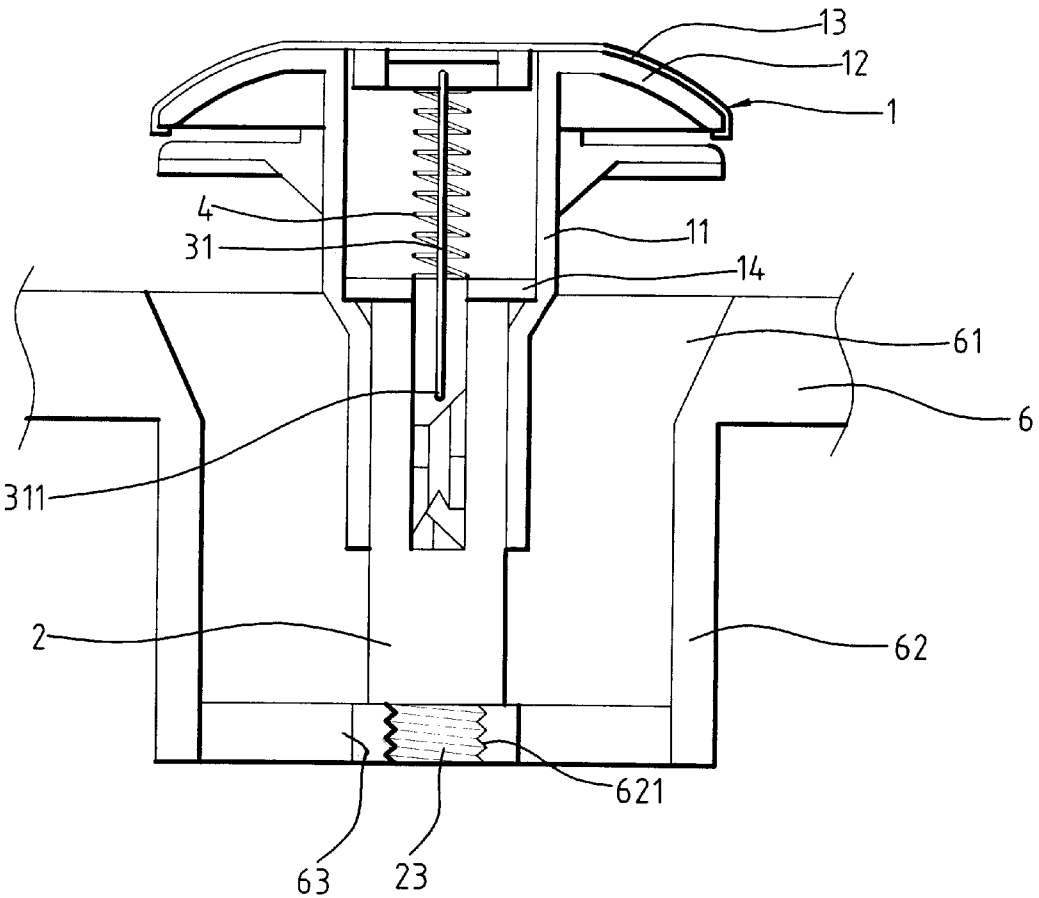
FIG. 3 shows a cross-sectional view in which the shutoff assembly of this invention is in an opened position.

With reference to FIG. 3, the shutoff assembly of this invention is assembled to a drain opening coupler 6. The drain opening coupler 6 has a drain hole 61. The bottom part of the drain opening coupler 6 is a coupler seat 62 on which a screw hole 621 is formed. Water can be drained through the area 63 around the screw hole 62. In assembling the shutoff assembly, the spring 4 is first disposed within the hole 21 of the plugging device 2. The plugging device 2 is placed in the through hole 121. The two side protruded portions 22 of the plugging device 2 are aligned with the recessed areas 123 of the main body 1.

The plugging device 2 is slipped into the through hole 121 and stopped at the upper portion of the hollow cylindrical body 11 because the two side protruded portions 22 are blocked by the lower portion. The hook lever 31 is placed into the side recessed slot 24 through the through hole 121 and the plugging cover 3 is placed above the plugging device 2. The two protruded portions 122 prevent the plugging cover 3 from falling into the through hole 121. The bottom hook 311 of the hook lever 31 is positioned above the protruded center piece 243 within the side recessed slot 24.

The shutoff cap 13 which has a shape matched to the shutoff member 12 of the main body 1 is affixed onto the shutoff member 12. The shutoff cap 13 and the shutoff member 12 are coupled and sealed together along the edge so that the through hole 121 is completely covered and closed from the above and the plugging cover 3 may not fall off. The two side protruded portions 22 are located within the recessed areas 123 within the through hole 121 to ensure that the plugging device 2 does not rotate around. The main body 1 is coupled with the drain cover 5 through a through hole 51 so that the drain cover 5 is positioned below the shutoff member 12.

The elastic force of the spring 4 pushes the plugging device 2 downwards. The drain opening coupler 6 is installed on the water outlet of a sink or bathtub. The bolt stud 23 of the plugging device 2 is screwed onto the screw hole 621 of the coupler seat 62 of the drain opening coupler 6. The opened position of a complete assembly of the shutoff assembly and the drain opening coupler 6 is shown in FIG. 3.

Figure 5:
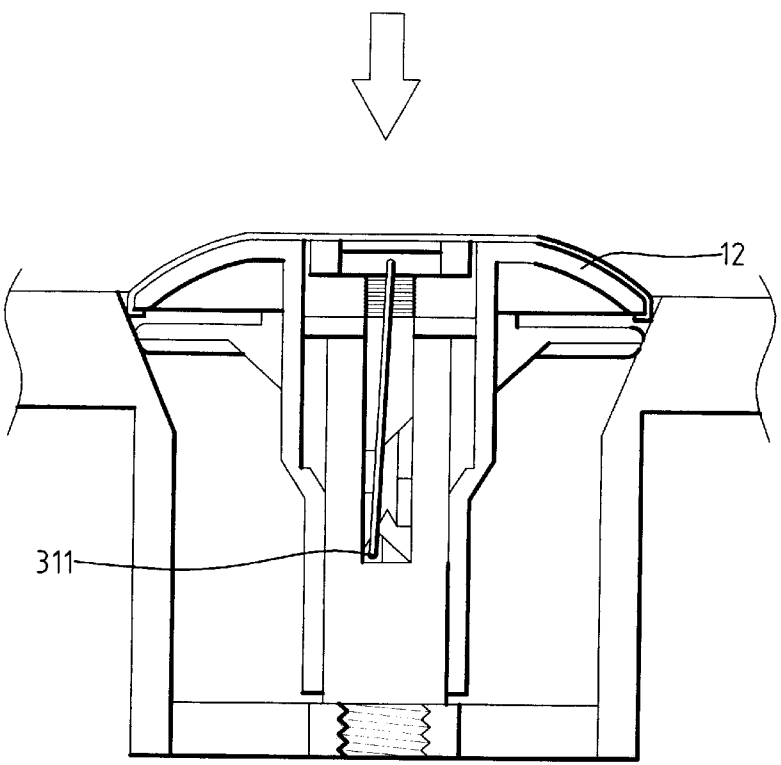
FIG. 5 shows a cross-sectional view in which the bottom hook of the hook lever moves towards the reversed V-shape recess at the bottom of the protruded center piece.
Figure 4:
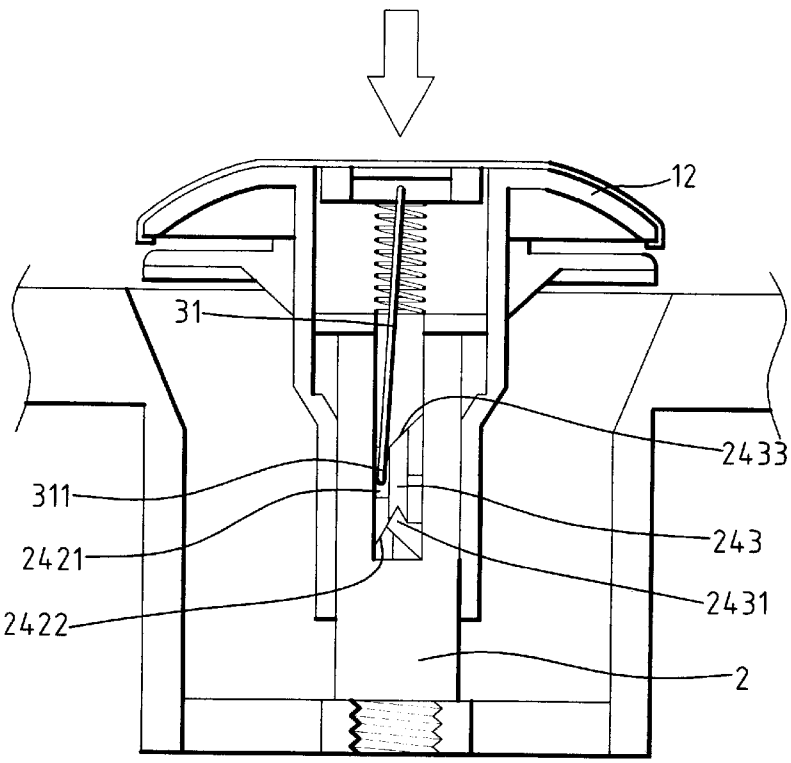
FIG. 4 shows a cross-sectional view in which the shutoff assembly of this invention is pressed and the hook lever moves downwards in the sliding path formed within the side recessed slot.
Figure 6:
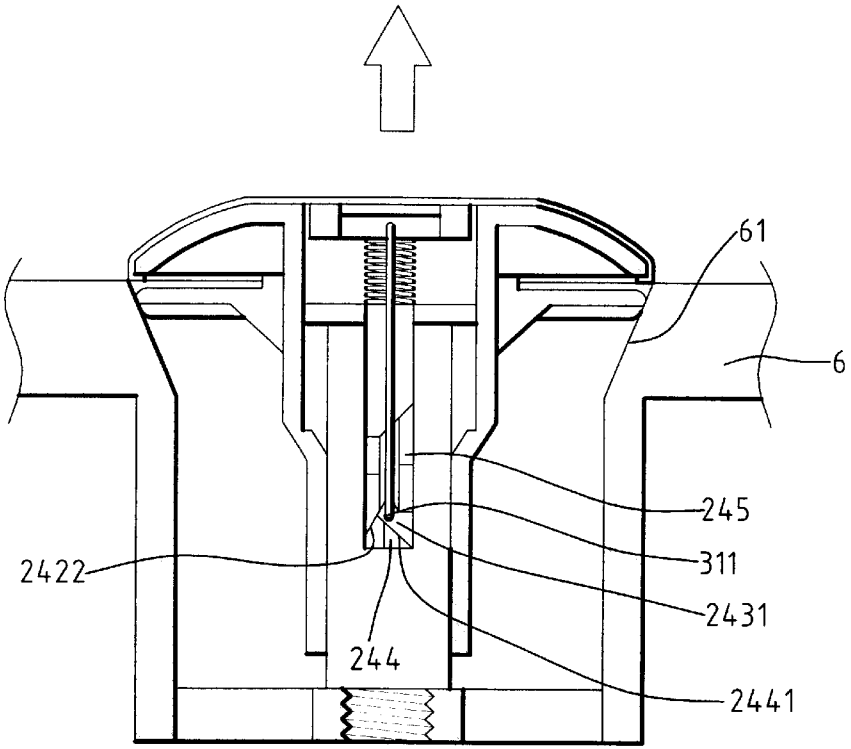
FIG. 6 shows a cross-sectional view in which the bottom hook of the hook lever is trapped in the reversed V-shape recess at the bottom of the protruded center piece and the shutoff assembly is in a closed position.

With reference to FIG. 4, a water outlet can be blocked by pressing the shutoff assembly downwards. Because the plugging device 2 is fixed on the coupler seat 62 by means of the bolt stud 23 and the screw hole 621, the main body 1 is moved downwards. The hook lever 31 is also moved down and the bottom hook 311 is guided by the slanted surfaces 2433 of the protruded center piece 243 into the sliding channel formed by the first side piece 242. The bottom hook 311 is further guided by the slanted surface 2421 into the area below the anti-reverse step 2422 as shown in FIG. 5. When the shutoff assembly is no longer pressed, the elastic force of the spring 4 moves the main body 1 upwards and the bottom hook 311 is guided and trapped into the reversed V-shape recess 2431 by the anti-reverse step 2422. In the mean time, the drain cover 5 below the shutoff member 12 blocks the drain hole 61 of the drain opening coupler 6. As shown in FIG. 6, the drain hole 61 is tightly covered and blocked by the drain cover 5 to stop water from being drained out.

Figure 7:
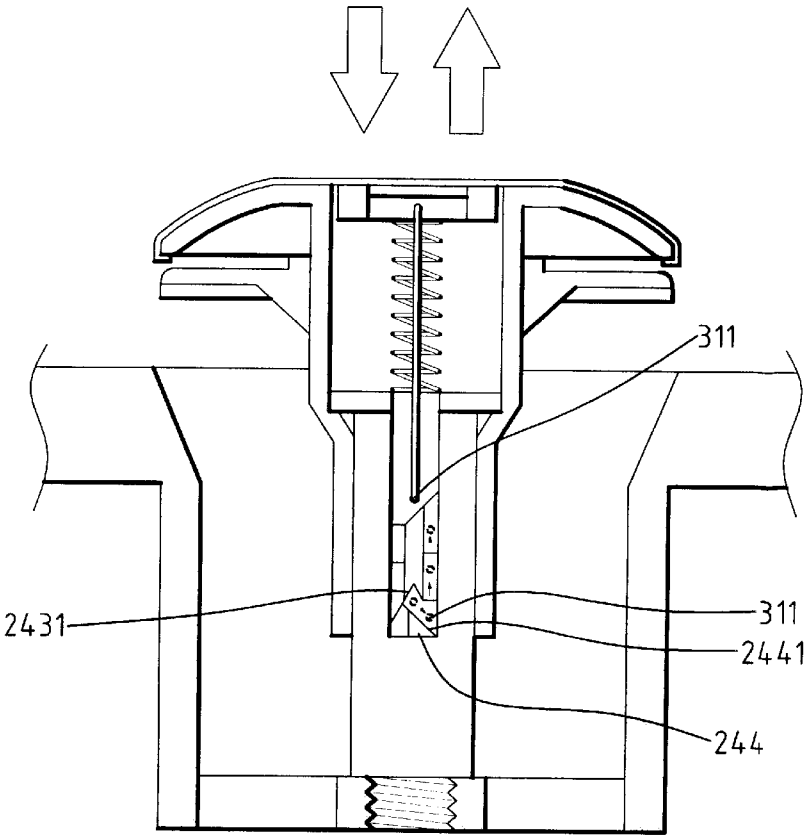
FIG. 7 shows a cross-sectional view in which the shutoff assembly of this invention is pressed again and the bottom hook of the hook lever moves downwards out of the reversed V-shape recess and upwards along the sliding path to return to an opened position.

When the water is to be drained out, the shutoff assembly is pressed downwards again. The bottom hook 311 is moved downwards and guided into the area below the second side piece 245 by the slanted side 2441 of the bottom triangular piece 244 as shown in FIG. 7. When the pressed force is released, the spring 4 further pushes the main body 1 upwards. The bottom hook 311 is guided up along the sliding channel formed by the second side piece 245 and returned to an opened position as shown in FIG. 3. The drain cover 5 is also moved away from the draining hole 61 to drain the water out.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A shutoff assembly, comprising:

a main body having a hollow cylindrical body, a shutoff member formed above said hollow cylindrical body, and a through hole, said through hole having an inner sidewall formed with two protruded portions;

a plugging device disposed within said through hole of said main body, said plugging device having a side recessed slot in which a sliding path is formed;

a hook lever disposed in said side recessed slot, said hook lever having a bottom hook;

a plugging cover disposed above said plugging device and said two protruded portions in said through hole, said hook lever having a top end attached to an edge of said plugging cover;

a shutoff cap covering said plugging cover and said shutoff member;

a spring disposed between said plugging cover and said plugging device; and a drain opening coupler having a coupler seat connected to a bottom end of said plugging device;

wherein said bottom hook slides downwards in said sliding path so as to be trapped in a bottom recess and said shutoff member blocks a drain hole of said drain opening coupler when said shutoff assembly is pressed, and said bottom hook moves out of said bottom recess and then upwards and said shutoff member is moved away from said drain hole when said shutoff assembly is pressed again.

2. The shutoff assembly as claimed in claim 1, wherein said side recessed slot has a protruded center piece formed near a bottom, first and second side pieces formed on two opposite sides of said protruded center piece, and a bottom triangular piece; said protruded center piece, said two side pieces and said bottom triangular forming said sliding path, and said protruded center piece having a bottom end formed with a reversed V-shape recess for trapping said bottom hook.

3. The shutoff assembly as claimed in claim 1, wherein said plugging device has a bottom bolt stud fastened to a screw hole formed on said coupler seat.

4. The shutoff assembly as claimed in claim 1, wherein said plugging device further has a top hole and said spring being disposed in said top hole.

5. The shutoff assembly as claimed in claim 1, further comprising a drain cover with a center hole, said drain cover being coupled to said main body below said shutoff member for blocking said drain hole of said drain opening coupler.

6. The shutoff assembly as claimed in claim 1, wherein said plugging device has a top end formed with two side protruded portions, and said hollow cylindrical body of said main body has an upper portion and a lower portion, said lower portion having a diameter slightly smaller than said upper portion to block said two side protruded portions of said plugging device.

* * * * *